US005852850A

United States Patent [19]

Hanten et al.

[11] Patent Number: 5,852,850

[45] Date of Patent: Dec. 29, 1998

[54] CHAIN OF CLOSURE CLIPS AND DEVICE AND PROCESS FOR CLOSING ITS CLIPS

[75] Inventors: Jürgen Hanten, Rockenberg, Germany; Eggo Haschke, Deerfield, Ill.; Walter Grzondziel, Frankfurt am Main; Günter Vermehren, Usingen, both of Germany

[73] Assignee: Poly-Clip System Corp., Mundelein, Ill.

[21] Appl. No.: 894,278

[22] PCT Filed: Jan. 15, 1996

[86] PCT No.: PCT/EP96/00208

§ 371 Date: Nov. 10, 1997

§ 102(e) Date: Nov. 10, 1997

[87] PCT Pub. No.: WO96/25340

PCT Pub. Date: Aug. 22, 1996

[30] Foreign Application Priority Data

Feb. 17, 1995 [DE] Germany ..... 195 05 359.1

[51] Int. Cl.[6] ..... B65D 33/16; A43C 7/00

[52] U.S. Cl. ..... 24/20 R; 24/30.5 R; 24/16 PB; 206/340

[58] Field of Search ..... 24/30.5 R, 30.5 D, 24/17 AP, 16 PB, 517, 559, 570, 571, 20 TT, 27, 563, 543, 343, 907; 383/71; 248/68.1, 74.2, 205.3; 206/338, 340, 343, 345, 348

[56] References Cited

U.S. PATENT DOCUMENTS

| | | | |
|---|---|---|---|
| 2,056,180 | 10/1936 | Flood | 206/340 |
| 2,881,915 | 4/1959 | Koehler et al. | 206/340 |
| 3,078,533 | 2/1963 | Allen | 206/340 X |
| 3,503,119 | 3/1970 | Seitz et al. | 24/30.5 R X |
| 3,506,116 | 4/1970 | Winters | 24/27 X |
| 3,587,204 | 6/1971 | George | 24/30.5 R X |
| 3,613,878 | 10/1971 | Langas et al. | 206/340 |
| 3,818,553 | 6/1974 | Parmenter | 24/30.5 R |
| 3,867,944 | 2/1975 | Samuels | 24/30.5 R X |
| 4,508,220 | 4/1985 | Pearson | 206/343 |
| 4,509,231 | 4/1985 | Paxton | 24/30.5 R |

(List continued on next page.)

FOREIGN PATENT DOCUMENTS

| | | | |
|---|---|---|---|
| 267847 | 5/1988 | European Pat. Off. . | |
| 3940262 | 7/1990 | Germany . | |
| 684472 | 9/1994 | Switzerland | B65D 67/02 |

*Primary Examiner*—Anthony Knight
*Assistant Examiner*—Robert J. Sandy
*Attorney, Agent, or Firm*—Sprung Kramer Schaefer & Briscoe

[57] ABSTRACT

The invention relates to a chain of interconnected closure clips, designed for the necks of bags or film tubes, having a uniform cross-sectional profile and two free ends lockable together to close the closure clip, which chain is characterized in that the closure clips comprise projections located in mutual alignment between the ends on the outer contour and are connected only in the region of these projections, such that the projections form a through-web. The invention further relates to a device for closing closure clips, especially in a closure clip chain according to the invention, with interlockable free ends, which is characterized in that it comprises a stamp with a cavity into which an unclosed closure clip may be non-rotatably inserted, in that the stamp may be moved to and fro with respect to a bottom tool and in that the bottom tool comprises deflection means for at least one of the free ends of the closure clip, to lock the two ends together upon movement of stamp and bottom tool towards each other. Furthermore, the invention includes a method of closing closure clips, especially such as those in a closure clip chain according to the invention, which is characterized in that an open closure clip suspended on the chain is fed to a closure device stamp, in that the stamp is thereafter moved, with the closure clip, towards a bottom tool and the closure clip is separated from the chain, in that the open closure clip is then moved by the stamp over a neck to be closed, in order to pick the latter up, and in that the free ends of the closure clip are then directed towards each other and locked together by associated deflection means in the bottom tool.

16 Claims, 9 Drawing Sheets

U.S. PATENT DOCUMENTS

| | | | |
|---|---|---|---|
| 4,581,481 | 4/1986 | Moretti | 24/487 X |
| 4,609,171 | 9/1986 | Matsui | 24/16 PB X |
| 4,663,807 | 5/1987 | Bozzo | 24/30.5 R |
| 4,742,601 | 5/1988 | Furutsu | 24/30.5 R |
| 4,791,014 | 12/1988 | West | 206/340 X |
| 4,881,301 | 11/1989 | Sweeney et al. | 24/16 PB X |
| 5,079,802 | 1/1992 | Blase et al. | 24/16 PB X |
| 5,109,576 | 5/1992 | Teekell et al. | 24/30.5 R |
| 5,123,146 | 6/1992 | Olsen | 24/30.5 R |
| 5,305,500 | 4/1994 | Tucker | 24/30.5 R |
| 5,598,608 | 2/1997 | Naslund | 24/30.5 R |

CHAIN OF CLOSURE CLIPS AND DEVICE AND PROCESS FOR CLOSING ITS CLIPS

The invention relates to a chain of interconnected closure clips, designed for the necks of bags and tubes, having a uniform cross-sectional profile and two free ends lockable together to close the closure clip.

The invention further relates to a device for closing closure clips with interlockable free ends, especially such as those of a closure clip chain according to the present invention. Furthermore, the invention includes a method of closing closure clips, especially such as those in a chain according to the present invention.

A chain of closure clips is already known from U.S. Pat. No. 3,818,553. However, the closure clips in the chain described therein comprise some considerable disadvantages. Thus, their two legs have to be swivelled by a relatively large angle for closure of a closure clip. In the area of the closure clip serving as a swivel axis said clip is consequently considerably weakened.

Furthermore, the closure clips in a chain are connected by a plurality of webs and otherwise comprise definite holes between said webs. These holes arise from punching effected after extrusion of the profile for the closure clip chain. The punched-out material constitutes undesirable waste. Moreover, the individual closure clips cannot be so very easily separated from each other owing to the plurality of connecting webs. Furthermore, the webs which remain damage the material of the neck of the bag upon closure of the closure clip.

A decisive disadvantage of all closure clips known hitherto consists in the fact that they are only inadequately suited to automatic supply and processing in automatic closure machines. This is particularly true even of the closure clip described above; mechanical closure of the closure clip is not looked into at all in U.S. Pat. No. '553.

The problem forming the basis of the invention is therefore that of providing a chain of interconnected closure clips which is particularly suitable for mechanical closure of their closure clips while avoiding the disadvantages of the prior art.

The solution to this problem lies, according to the invention, in a chain of interconnected closure clips of the type mentioned above, which is characterized in that the closure clips comprise projections located in mutual alignment between the interlockable free ends on the outer contour and are connected only in the region of these projections, such that the projections form a through-web.

The projections on the closure clips are of particular significance in this chain of closure clips. As a coherent web, they assist supply of the chain to a closure machine. Moreover, the projection on a closure clip clearly simplifies the action of holding a closure clip firm against rotation during closure. Moreover, the closure clips in a chain may be easily released from the chain by simple separation of the web formed by the projections. If the chain of interconnected closure clips is produced economically by extrusion, it is sufficient for the individual closure clips in the chain to be pre-divided by a simple incision extending from the free ends of the closure clips to the projection thereon. Expensive punching, associated with a large quantity of waste material, is unnecessary. A chain of interconnected closure clips manufactured in this way is not only characterized in that its closure clips can be easily separated from the chain, but also in that the chain can be rolled up and may thus be stored in roll form. Owing to the through-web, it may also be particularly satisfactorily fed to a device for closing the closure clips.

In an advantageous embodiment of the chain, the projections on the individual closure clips are located centrally between the free ends thereof.

Moreover, an embodiment is preferred, which is distinguished by a cross-sectional profile in which the free ends are at a distance from each other corresponding to the maximum diameter of a bag neck to be closed with a closure clip. Such an embodiment offers the great advantage that the load in the area of the closure clip deformed during closure is only very slight, such that the risk of failure is considerably reduced. Moreover, a closure clip pre-closed to such an extent may be particularly easily supplied to a machine for closure, the closure clip or the chain of interconnected closure clips sliding on a feed rail.

Furthermore, it is advantageous for the closure clips in the chain to have cross-sectional profiles whose inner contours are concavely preformed when the closure clip is open and corresponds substantially to that of a closed closure clip. With a thus preformed closure clip, the deformation thereof upon closure may be kept as slight as possible, with the result that the material loading upon closure is slight and the failure probability is reduced accordingly.

A particularly advantageous variant of the chain of interconnected closure clips according to the invention is characterized by a cross-sectional profile in which the inner contour comprises a recess at the point where the projection is located on the outer contour. A further optimised variant of this chain of interconnected closure clips is further characterized in that the profile thickness of the cross-sectional profile in the entire area between the two free ends is approximately constant. In a chain of interconnected closure clips composed in this way, the area of the individual closure clip subjected to particular load during closure comprises a uniform wall thickness. This leads to uniform distribution of bending and thus of loading during closure of the closure clip. It may therefore be expected that no fracture will occur. Moreover, a closure clip formed in this way offers the possibility of adaptation to various neck diameters, because the closure clip may expand somewhat in the region of the projection owing to the recess.

Finally, another variant of the chain of interconnected closure clips comprises a cross-sectional profile in which the inner contour is provided with teeth. The teeth permit the easy compensation of various neck diameters. In particular, it is possible to provide different cross-sectional profiles for different applications (neck diameters), which differ from each other only in the length of their teeth. The outer contours of the closure clips may remain the same, such that the different closure clips may all be closed with the same closure tool.

The invention furthermore comprises a device of the above-mentioned type which is characterized in that it comprises a feed means for the closure clips and a stamp with a cavity, each of which has a groove for guiding and non-rotatably receiving the closure clip projections, where the grooves are aligned when the stamp assumes its remotest position from the bottom tool, in that the stamp may be moved to and fro with respect to a bottom tool and in that the bottom tool comprises deflection means for at least one of the free ends of the closure clip, to lock the two ends together upon movement of stamp and bottom tool towards each other.

With such a device, the above-described closure clips may be particularly easily closed. Moreover, the device according to the invention is characterized in that it is sufficient for the stamp alone to be made to be movable. The device thus requires particularly few movable parts, is therefore cheap to produce and operates with particularly low wear.

The device according to the invention advantageously comprises deflection means for both free ends of the closure clip. Moreover, these are preferably arranged stationarily with respect to each other and, in a preferred embodiment, are constructed as slide faces. The deflection means may therefore be integral components of the bottom tool, such that the latter may be manufactured from a single piece.

A preferred variant of the device is characterized in that the stamp and the feed means each comprise an edge, which edges interact in the manner of shears upon movement of stamp and bottom tool towards each other and separate an open closure clip from the chain. Separation of the closure clips from the chain is therefore particularly easy to achieve with the device.

The stamp which the device comprises may preferably be moved in a stamp guide. Moreover, it is advantageous if the feed means for the closure clips opens in the stamp guide.

Finally, in a preferred embodiment of the device the stamp guide comprises, between the mouth of the feed means and the bottom tool, an opening for the insertion of a neck to be closed. In such an arrangement, the stamp with the opened closure clip is guided during its movement towards the bottom tool past the opening and over a foil neck or the like to be closed, such that the neck is inserted into the open closure clip.

The invention also comprises a method of the above-mentioned type, which is characterized in that an open closure clip suspended on the chain is fed to a closure device stamp, in that the stamp is thereafter moved, with the closure clip, towards a bottom tool and the closure clip is separated from the chain, in that the open closure clip is then moved by the stamp over a neck to be closed, in order to pick the latter up, and in that the free ends of the closure clip are then directed towards each other and locked together by associated deflection means in the bottom tool. The method according to the invention is simple and effective and, moreover, particularly suited to showing off to full advantage the advantages of the above-described closure clip.

Exemplary embodiments of the invention will now be described below with the aid of drawings, in which.

Figure 1:
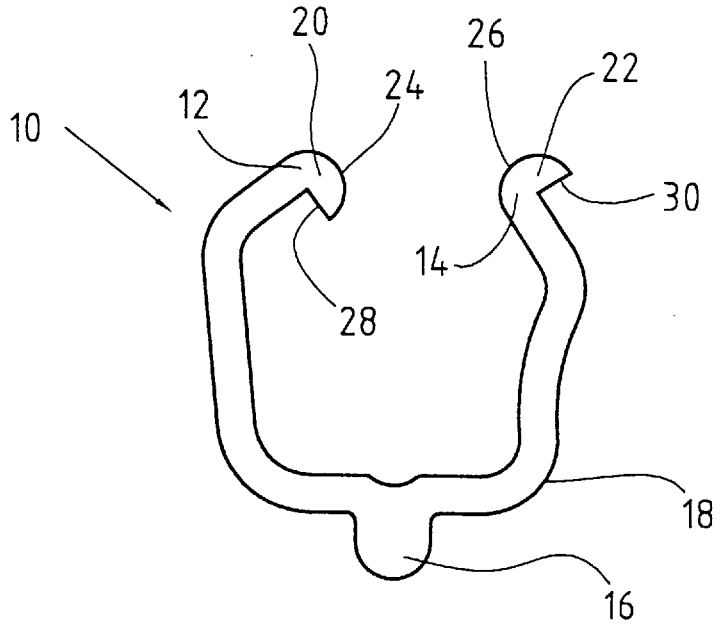
FIG. 1 is a side view of a closure clip according to the invention.

The shape of the cross-sectional profile of the closure clip 10 may be clearly seen from the side view of an embodiment of the closure clip according to the invention. This cross-sectional profile is simultaneously the cross-sectional profile of a chain of interconnected closure clips 10. It is characterized by the following features: it comprises two free interlockable ends 12 and 14. Between these two free ends the profile thickness of the closure clip 10 is substantially equal, with the exception of a projection 16. The projection 16 is located on the outer contour 18 of the closure clip 10 approximately centrally between the two free ends 12 and 14. Although closure clips with a substantially uniform profile thickness are preferred, it is also possible—if the application requires it—to provide a closure clip 10 with a profile thickness starting from the projection 16 and becoming uniformly larger or smaller, for example. It goes without saying, moreover, that other variants of the profile thickness of the closure clip 10 are feasible.

The free ends 12 and 14 of the closure clip 10 are provided with locking catches 20 and 22 respectively. The locking catch 20 is located on the free end 12 and is directed inwards with respect to the closure clip, while the locking catch 22 on the free end 14 is directed outwards. The two locking catches 20 and 22 comprise end faces 24 and 26 respectively and locking faces 28 and 30 respectively. When the closure clip is closed, its two locking faces 28 and 30 lie directly opposite each other and are in contact. The free ends 12 and 14 are then locked together.

Figure 7:
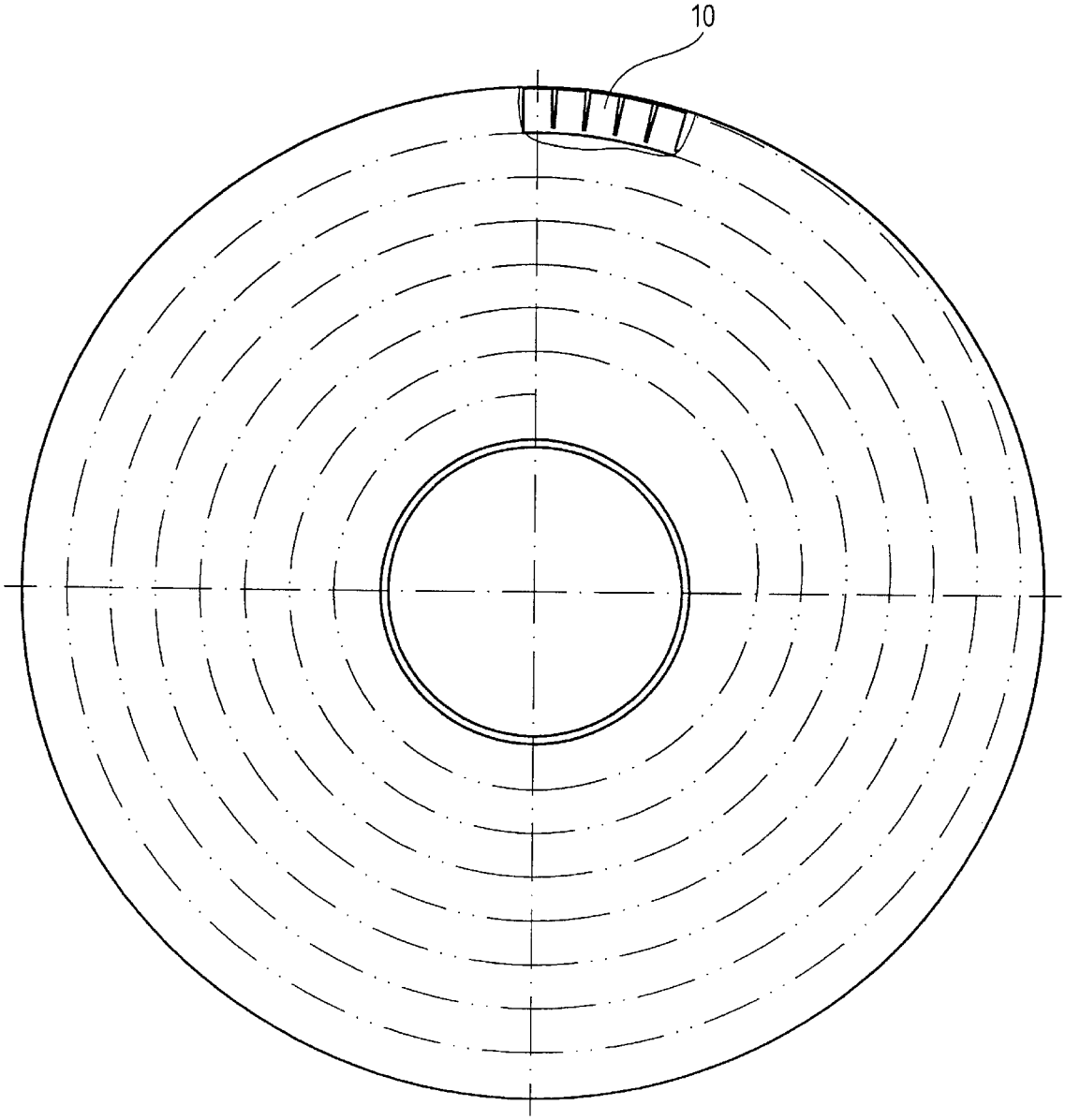
FIG. 7 shows a rolled-up closure clip chain on a spool.

The closure clip 10 is made with the above-described uniform cross-sectional profile by extrusion of plastics material, for example. The individual closure clips 10 are formed by division of the extruded member. Before processing of a closure clip, the extruded member is pre-divided, but not completely, in accordance with the length of the individual closure clips, such that a chain of interconnected closure clips is formed. The pre-division of an extruded member for the purpose of producing a chain of interconnected closure clips is advantageously effected by an incision in the extruded member extending from the free ends of the cross-sectional profile as far as the projection 16. This incision extends, for each individual closure clip 10, precisely as far as the projection 16, such that the closure clips of a chain are connected at their respective projections and the projections 16 form a through-web. Since a simple incision suffices for pre-division of the individual closure clips, expensive punching can be dispensed with, for example, and no material is lost as waste. Such a chain of interconnected closure clips may be rolled up towards the web, the incisions then spreading, such that the free ends of different closure clips become correspondingly remote from each other. A correspondingly rolled-up chain of interconnected closure clips is shown in FIG. 7 in side view.

Figure 2:
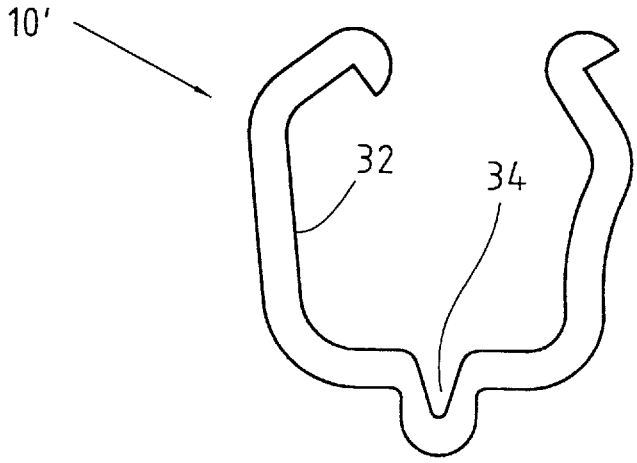
FIG. 2 shows a variant of the closure clip of FIG. 1 with substantially uniform profile thickness.

FIG. 2 shows a variant of the closure clip 10 of FIG. 1. In this variant 10', the inner profile 32 comprises a recess 34 at the point where the projection 16 is located on the outer profile 18. In this way, a uniform profile thickness of the closure clip 10' between the two free ends 12 and 14 thereof is even obtained in the area of the projection 16. This uniform profile thickness leads, in particular, to uniform loading of the closure clip upon closure thereof. Moreover, the closure clip 10' may expand somewhat in the area of the projection 16 or the recess 34 upon closure, such that in this way even film tube necks with a somewhat larger diameter than correspond to the unexpanded closure clip 10' may be closed.

Figure 3:
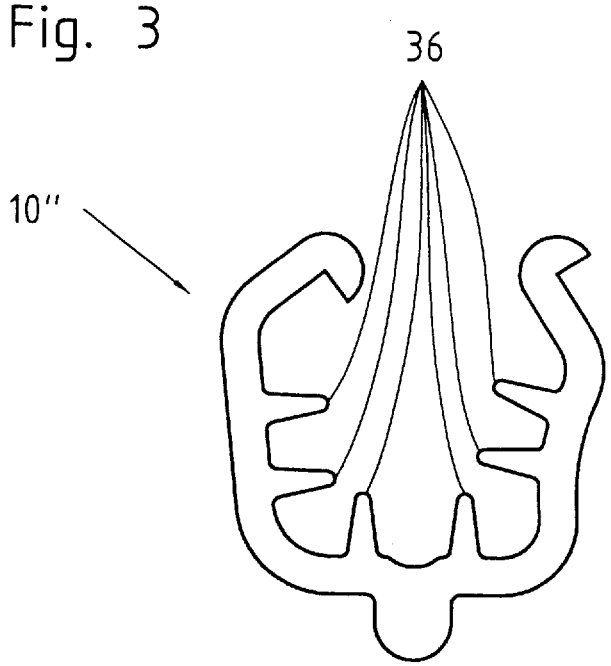
FIG. 3 shows a variant of the closure clip of FIG. 1 with teeth projecting on the inner profile.

Compensation of different neck diameters is also possible by the provision of teeth on the inner profile 32 of a closure clip, as shown in FIG. 3. The teeth 36 on the inner profile 32 of the closure clip 10" may, moreover, sink into the film neck and in this way prevent or at least make more difficult slipping of the closed closure clip 10". Furthermore, different cross-sectional profiles may be used which differ only in the length of the teeth 36 to compensate for varying neck diameters. The outer contour 18 may thus, in all variants of the closure clip, always be the same, such that for all variants the same closing tools may also be used. It is thus not necessary to stock different closing tools for differing neck diameters and correspondingly different closure clips.

Moreover, the locking pressure of a closure clip may also be adapted to the respective application without variation of this cross-sectional profile, by separation of the respective closure clip from the extruded member either with a greater length for greater locking pressure or with a smaller length for less locking pressure.

Figure 4:
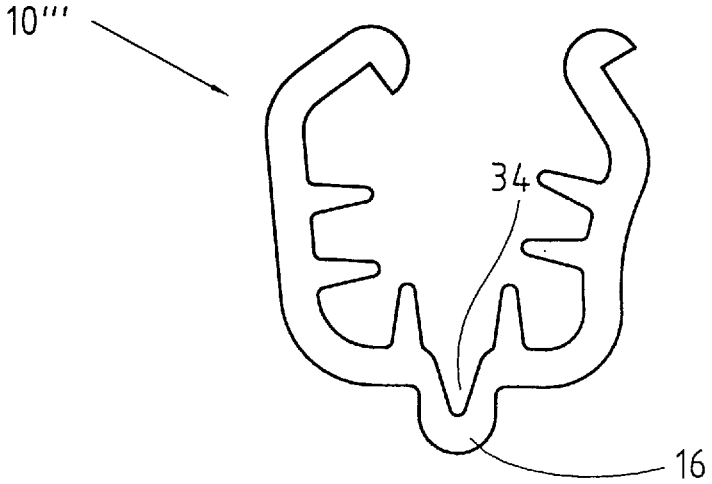
FIG. 4 shows a variant of the closure clip of FIG. 2 with teeth projecting on the inner profile.
Figure 5:
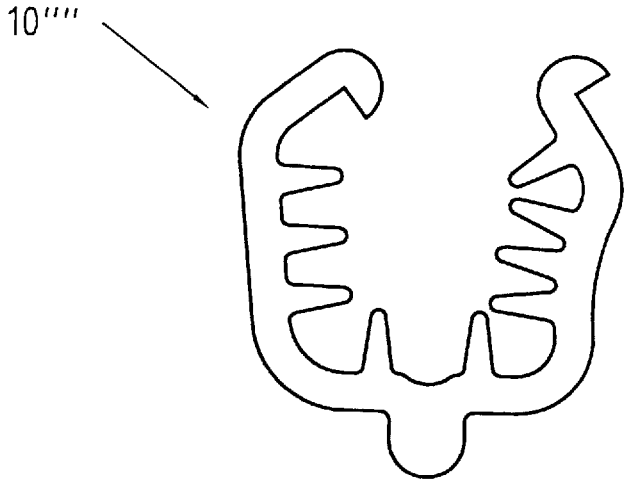
FIG. 5 shows a variant of the closure clip of FIG. 3 with a larger number of teeth on the inner profile.
Figure 6:
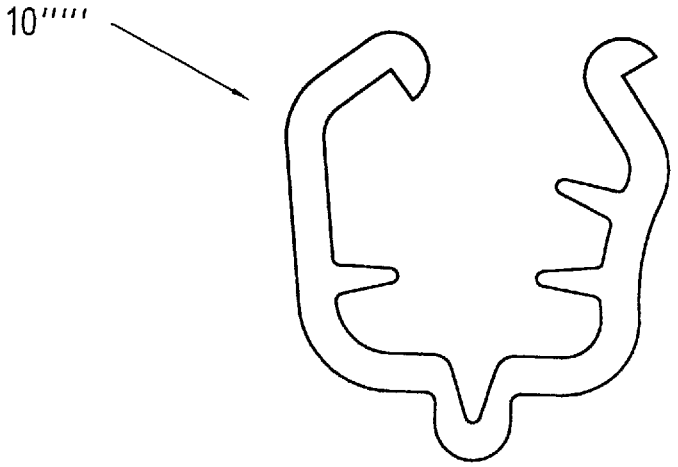
FIG. 6 shows a closure clip according to FIG. 4 with a smaller number of teeth.

As may be seen in FIG. 4, the provision of teeth on the inner profile 32 of a closure clip 10"' may also be combined with a recess 34 opposite the projection 16. Likewise, the number of teeth 36 on the inner profile 32 may be increased, as shown in FIG. 5, or reduced, as shown in FIG. 6. In the latter two cases a recess 34 may be provided, if so desired.

Figure 8:
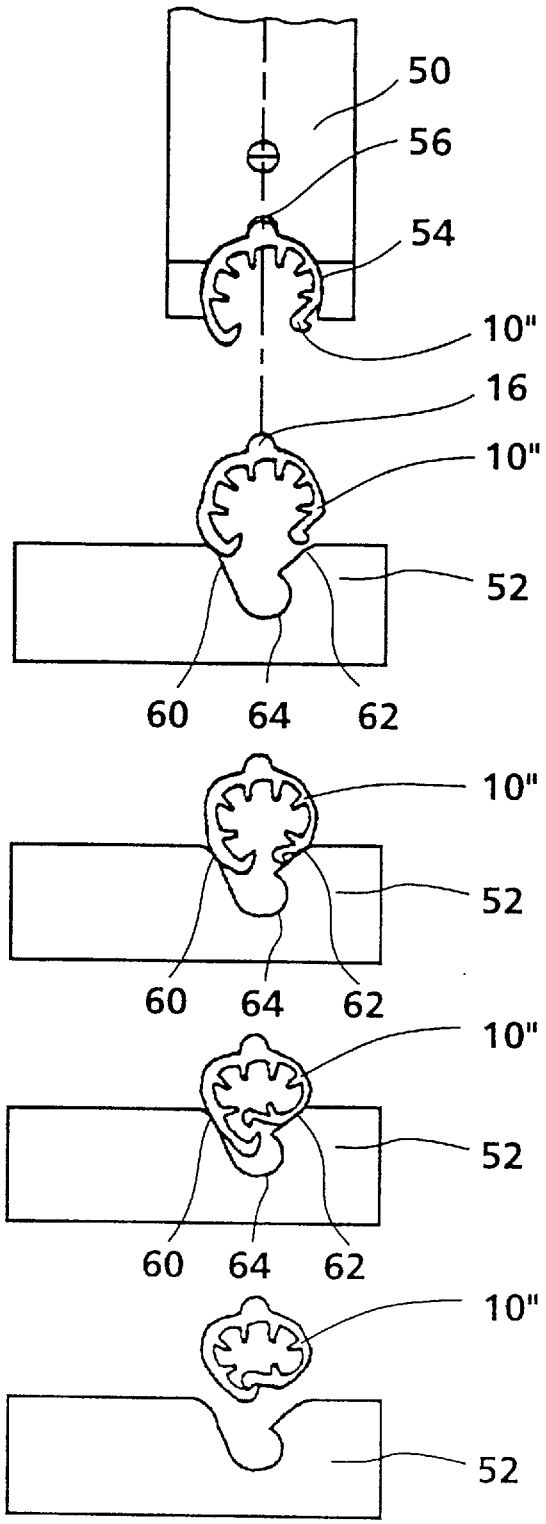
FIG. 8 is a schematic diagram to illustrate the method according to the invention for closing a closure clip, including a sketch-type representation of the stamp, the bottom tool and a closure clip in various stages of the closure process.

FIG. 8 shows, in addition to a closure clip 10" in various stages of the closure process, the two essential components of a device for closing the closure clip, i.e. a stamp 50 and a bottom tool 52. The stamp 50 comprises a cavity 54, in which the closure clip 10" is held non-rotatably. Of particular benefit to non-rotatability is a groove 56 in the cavity 54, into which the projection 16 on the closure clip 10" may project, as illustrated. As long as the main requirements of the cavity 54 in the stamp 50 are fulfilled, namely that it holds the closure clip non-rotatably, the cavity 54 may have any form. In the exemplary embodiment described, its inner contour is substantially conformed to the outer contour of the closure clip.

The bottom tool 52 also comprises a recess, whose two side faces form slide faces 60 and 62 respectively. The slide faces 60 and 62 act as deflection means for the free ends 12 and 14 of the closure clip 10" upon closure thereof. These deflection means do not necessarily have to be slide faces as in the exemplary embodiment; they may, for example, also be constructed as rotatable rollers or, in the case of spherical surfaces, make only punctiform contact with the free ends and adjoining portions of the closure clip 10". The bottom tool 52 shown may be particularly simply made from one piece. In the exemplary embodiment, the slide face 60 exhibits an angle of inclination of 67°, while the slide face 62 exhibits an angle of inclination of 43°. The slide face 60 extends deeper into the bottom tool 52 than the slide face 62 and opens in a round recess 64, which undercuts the slide face 62.

Prior to a full description of the method, the process of closing a closure clip with the aid of the stamp 50 and bottom tool 52 will be explained here to clarify the basic principle. First of all, an open closure clip is inserted into the cavity 54 of the stamp 50. The stamp 50 with inserted closure clip 10" is then moved towards the bottom tool 52. Even on insertion the closure clip 10" is so oriented that, when the stamp 50 and bottom tool 52 move towards each other, the free end 12 moves with its inwardly directed locking catch 20 towards the first slide face 60, while the second free end 14 moves with its outwardly directed locking catch 22 towards the second slide face 62. As soon as the two free ends 12 and 14 of the closure clip 10" reach the associated slide faces 60 and 62 through the movement towards each other of stamp 50 and bottom tool 52, the free ends 12 and 14 are deflected towards each other. At the same time, the free end 14 with the outwardly directed locking catch 22 is pushed back more strongly than the free end 12 with the inwardly directed locking catch 20, with the result that, as the stamp 50 and bottom tool 52 continue their movement towards each other, the locking catches 20 and 22 may move past each other and interlock. In this process the end faces 24 and 26 with the locking catches slide along each other first of all, until the locking faces 28 and 30 undercut the locking catches 20 and 22 and the two free ends 12 and 14 of the closure clip 10" are locked together. When the stamp 50 is then moved away from the bottom tool 52, the closure clip 10" remains closed.

A particular construction of the stamp 50 and the bottom tool 52 improves the precise interaction of the two during closure of a closure clip. This particular construction may be seen in FIG. 9. The bottom tool 52 namely comprises, in addition to the recess with the two slide faces 60 and 62, two other recesses 70 and 72 extending parallel with the direction of movement of the stamp, which recesses 70 and 72 are so constructed that two free ends 74 and 76 on the end of the stamp 50 facing the bottom tool 52 may slide into the recesses 70 and 72 during the movement towards each other of the stamp 50 and bottom tool 52. In this way, the stamp 50 may also be reliably guided with its free ends 74 and 76 in the recesses 70 and 72 during the last phases of the closure process.

Figure 9:
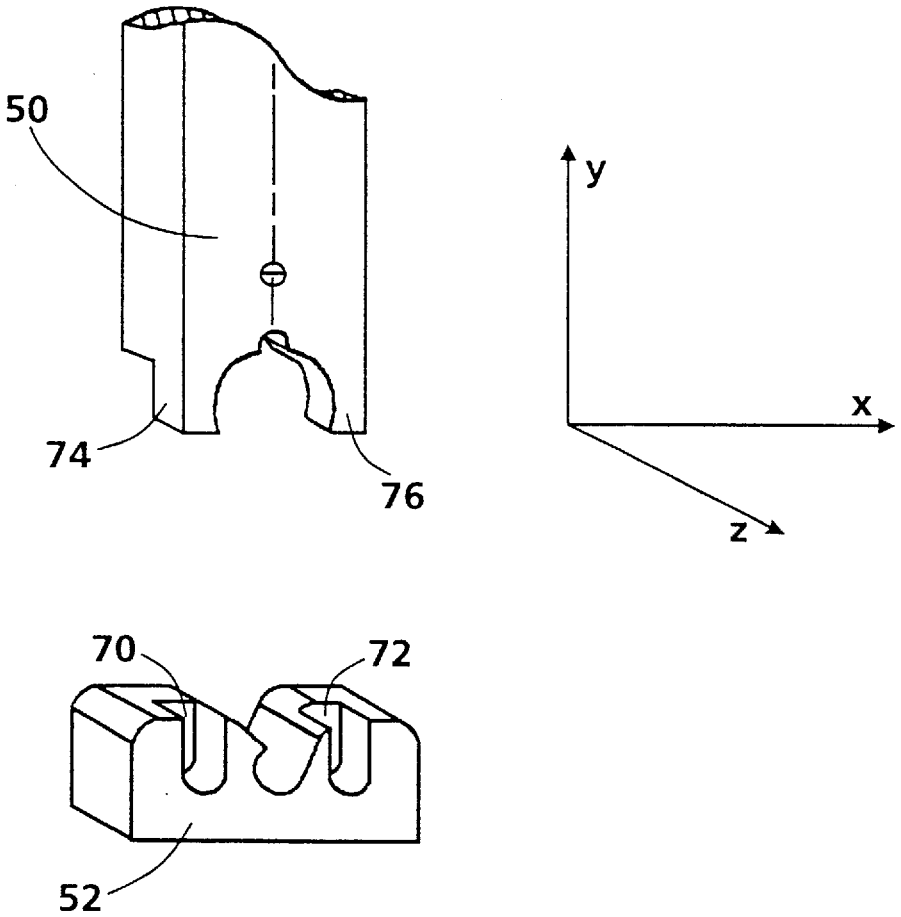
FIG. 9 is a detailed perspective representation of the stamp and the bottom tool of FIG. 8.

In the exemplary embodiment, the extension, hereinafter designated thickness, of the stamp 50 and the bottom tool 52 with respect to the system of coordinates illustrated in FIG. 9 is the same in the Z-direction. Only the free ends 74 and 76 of the stamp 50 are only half as thick as the rest of the stamp 50 where they are designed to enter the recesses 70 and 72 in the bottom tool 52. These recesses 70 and 72 accordingly extend in the thickness direction of the bottom tool only as far as somewhat over half of its thickness otherwise. It goes without saying that the recesses 70 and 72 are located on that side of the bottom tool 52 which corresponds to that side of the stamp 50 on which the free ends 74 and 76 thereof project furthest towards the bottom tool.

Figure 10:
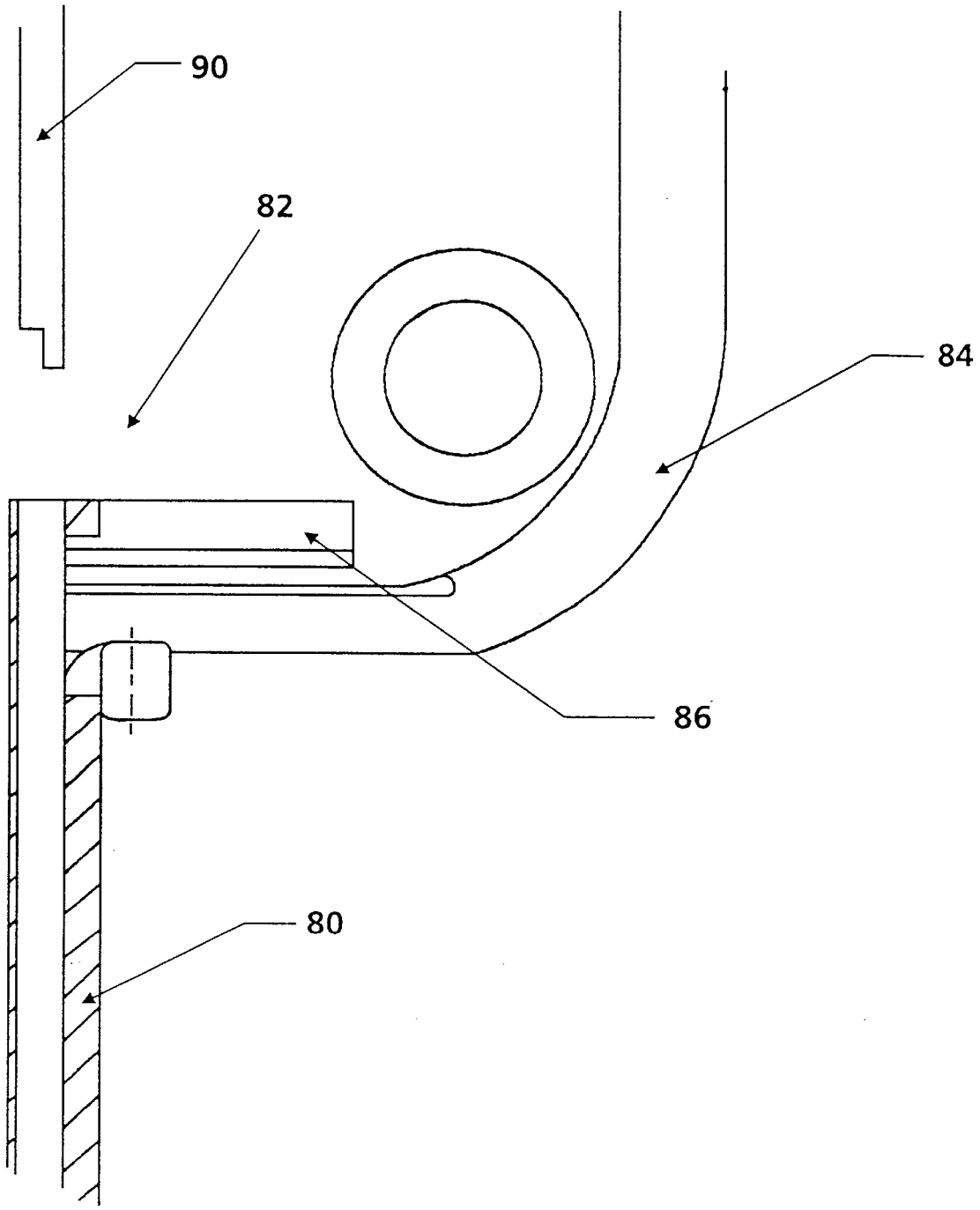
FIG. 10 shows a section through the upper part of a stamp guide and a closure clip feed means of the device according to the invention for closing closure clips.

FIG. 10 shows a section through a stamp guide 80, into which the stamp 50, likewise shown in side view, may be inserted. At the same time, a feed means 82 for a chain of interconnected closure clips may be seen. This feed means consists of a rail 84 on which the closure clips may ride. Moreover, the feed means comprises a guide member 86 with a longitudinal groove 88 to guide cleanly the projections 16 of the closure clips forming the web of the closure clip chain.

Figure 11:
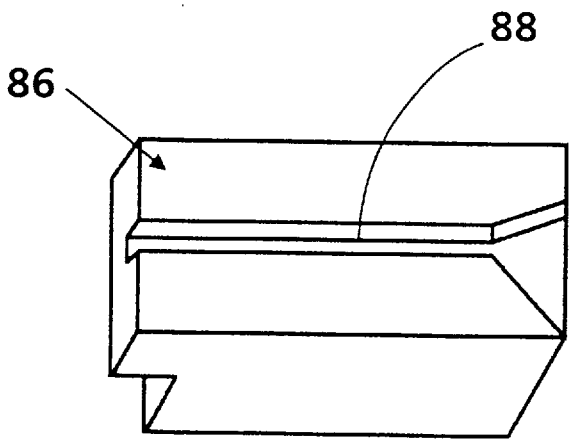
FIG. 11 is a perspective representation of a component of the closure clip feed means of FIG. 10.

FIG. 11 is a perspective representation of the guide member 86, which makes clear the fact that the longitudinal groove 88 in the guide member 86 widens on the inlet side to simplify insertion of the closure clip chain web formed of the projections 16. When the stamp 50 is inserted into the stamp guide 80 and has assumed its position which, in normal operation, is furthest from the bottom tool 52, the groove 56 in the cavity 54 in the stamp 50 and the longitudinal groove 88 in the guide member 86 are precisely aligned with each other. This ensures reliable insertion of a closure clip into the cavity in the stamp 50. If, after insertion of a closure clip, the stamp is moved towards the bottom tool, the inserted closure clip is automatically separated from the rest of the closure clip chain. It may then subsequently be closed as described above.

Reference should additionally be made to the fact that, in the side view of the stamp 50 shown in FIG. 10, it may clearly be seen that the thickness thereof reduces to half at its end facing the bottom tool 52.

Figure 12:
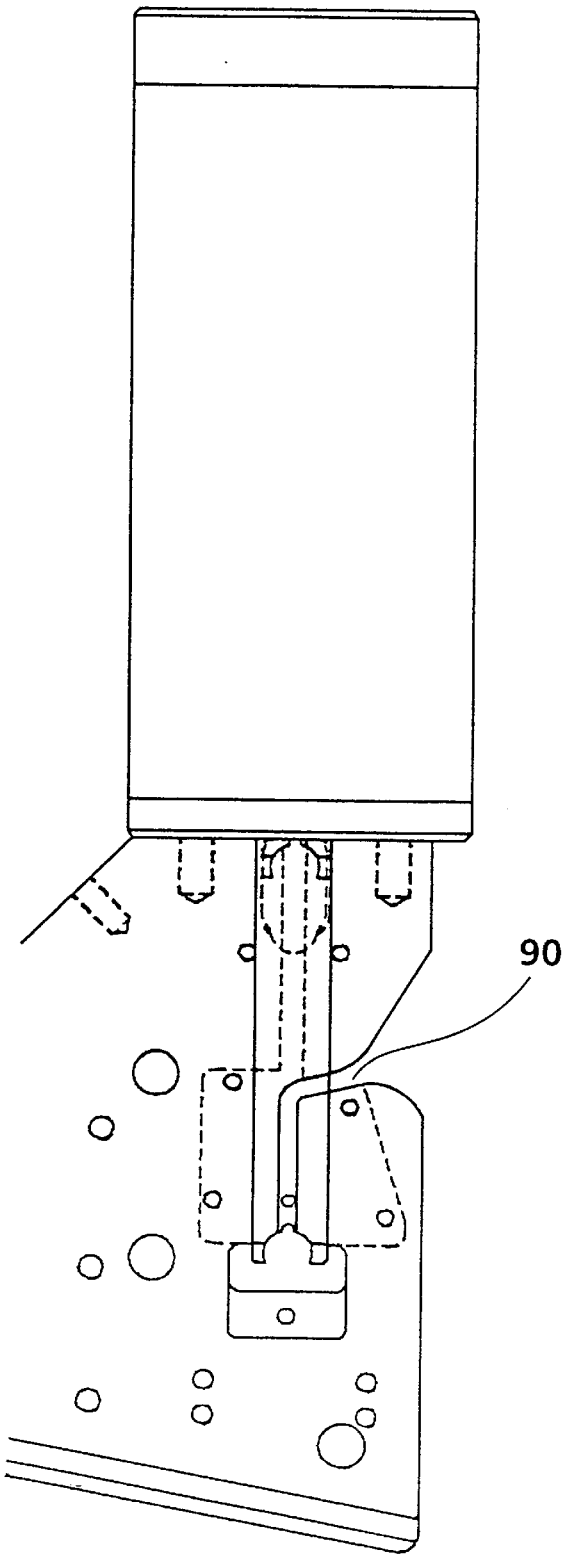
FIG. 12 is a front view of the parts relevant to the invention of the device according to the invention for closing closure clips.

Finally, the front view in FIG. 12 shows how the individual parts of the closing device interact with each other and especially how a neck to be closed may be fed to the closing device. The stamp guide 80 comprises a lateral opening 90, which leads to the centre of the stamp guide 80 and continues along the centre of the stamp guide 80 to the end thereof on the bottom tool side.

A bag neck to be closed may be inserted through this opening 90 as far as the centre of the stamp guide 80. There the bag neck is entrained by the still open closure clip in the cavity 54 in the stamp 50, when the stamp 50 with the closure clip is moved towards the bottom tool 52. It is thus inserted into the closure clip and finds itself inside the closure clip when the latter is closed.

To close a bag neck with the aid of a closure clip, first of all the bag neck is guided through the opening 90 to the centre of the stamp guide 80. Then, after insertion of an open closure clip, the stamp 50 is moved towards the bottom tool. For this purpose, the closure clip is firstly separated from the closure clip chain. As the stamp 50 continues to move, the open closure clip takes the bag neck with it and accommodates it inside it. Guided by the stamp 50, the open closure clip with bag neck inside it then reaches the bottom tool. It is finally closed thereby in the manner already described. After closure of the closure clip the bag neck is located inside the former and held closed by it. It may be removed from the closing device with the closure clip surrounding it through the opening 90, as soon as the stamp has been moved far enough away from the bottom tool. Alternatively, the neck with closure clip may be removed earlier from the bottom tool 54 towards the observer with respect to FIG. 12.

We claim:

1. A chain of interconnected closure clips, designed for necks of bags or film tubes, having a uniform cross-sectional profile and two free ends lockable together to close the closure clip, characterized in that the closure clips (10, 10', 10", 10''', 10'''', 10''''') comprise projections (16) located in mutual alignment between the ends (12, 14) on the outer contour (18) and are connected only in the region of these projections (16), such that the projections (16) form a through-web.

2. A chain of interconnected closure clips according to claim 1, characterized in that the projections (16) are located centrally between the free ends (12, 14).

3. A chain of interconnected closure clips according to claim 1, characterized by a cross-sectional profile, in which the free ends (12, 14) are at a distance from each other corresponding to the maximum diameter of a bag neck to be closed with a closure clip (10, 10', 10", 10''', 10'''', 10''''').

4. A chain of interconnected closure clips according to claim 1, characterized by a cross-sectional profile whose inner contour (32) is concavely preformed when the closure clip (10, 10', 10", 10''', 10'''', 10''''') is open and corresponds substantially to that of a closed closure clip (10, 10', 10", 10''', 10'''', 10''''').

5. A chain of interconnected closure clips according to claim 1, characterized by a cross-sectional profile, in which the inner contour (32) comprises a recess (34) at the point where the projection (16) is located on the outer contour (18).

6. A chain of interconnected closure clips according to claim 4, characterized in that the profile thickness of the cross-sectional profile in the entire area between the two free ends (12, 14) is approximately constant.

7. A chain of interconnected closure clips according to claim 1, characterized by a cross-sectional profile, in which the inner contour (32) comprises teeth (36).

8. A device for closing closure clips from a closure clip chain according to claim 1, comprising a stamp (50), bottom tool (52) and a feed means (82) for the closure clips (10, 10', 10", 10''', 10'''', 10''''') with a groove (88) for guiding the projections (16) thereof, said stamp (50) having a cavity (54), which has a groove (56) for non-rotatably receiving the projection (16) of a closure clip (10, 10', 10", 10''', 10'''', 10'''''), where the groove (56) in the cavity (54) of the stamp (50) is aligned with the groove (88) in the feed means (82), when the stamp (50) assumes its remotest position from the bottom tool (52), that the stamp (50) may be moved to and from with respect to said bottom tool (52), and that the bottom tool (52) comprises deflection means (60, 62) for at least one of the free ends (12, 14) of the closure clip (10, 10', 10", 10''', 10'''', 10'''''), to lock the two ends (12, 14) together upon movement of stamp (50) and bottom tool (52) towards each other.

9. A device according to claim 8, characterized in that the device comprises deflection means (60, 62) for both free ends (12, 14) of the closure clip (10, 10', 10", 10''', 10'''', 10''''').

10. A device according to claim 9, characterized in that the deflection means (60, 62) are stationary with respect to each other.

11. A device according to claim 8, characterized in that the deflection means (60, 62) are designed as slide faces.

12. A device according to claim 8, characterized in that the stamp (50) and the feed means (82) each comprise an edge, which edges interact in the manner of shears upon movement of stamp (50) and bottom tool (52) towards each other and separate an open closure clip (10, 10', 10", 10''', 10'''', 10''''') from the chain.

13. A device according to claim 8, characterized in that the stamp (50) is movable in a stamp guide (80).

14. A device according to claim 13, characterized in that the feed means (82) for the closure clips (10, 10', 10", 10''', 10'''', 10''''') opens in the stamp guide (80).

15. A device according to claim 14, wherein the stamp guide (80) comprises a lateral opening (90), which leads to the center of the stamp guide (80) and continues along the center of the stamp guide (80) to the end thereof on the bottom tool side for the insertion of a neck to be closed.

16. A method of closing closure clips from a closure clip chain according to claim 1, characterized in that an open closure clip (10, 10', 10", 10''', 10'''', 10''''') suspended on the chain is fed to a stamp (50) of a closing device and by means of its projection (16) is non-rotatably inserted in the same, that the stamp (50) is thereafter moved, with the closure clip (10, 10', 10", 10''', 10'''', 10''''') towards a bottom tool (52) and the closure clip (10, 10', 10", 10''', 10'''', 10''''') is separated from the chain, that the open closure clip (10, 10', 10", 10''', 10'''', 10''''') is then moved by the stamp (50) over a neck to be closed, in order to pick the latter up, and that the free ends (12, 14) of the closure clip (10, 10', 10", 10''', 10'''', 10''''') are then directed towards each other and locked together by associated deflection means (60, 62) in the bottom tool (52).

* * * * *